United States Patent [19]

Torii et al.

[11] Patent Number: 5,065,430

[45] Date of Patent: Nov. 12, 1991

[54] VOICE BAND SPLITTING SCRAMBLER

[75] Inventors: Naoya Torii, Yokohama; Ryota Akiyama, Suginami; Mitsuhiro Azuma, Kawasaki, all of Japan

[73] Assignee: Fujitsu Limited, Kawasaki, Japan

[21] Appl. No.: 222,614

[22] Filed: Jul. 21, 1988

[30] Foreign Application Priority Data

Jul. 21, 1987 [JP] Japan ..... 62-182080

[51] Int. Cl.[5] ..... H04K 1/04

[52] U.S. Cl. ..... 380/38; 380/9; 380/39

[58] Field of Search ..... 380/9, 31, 33, 14, 36, 380/38, 39

[56] References Cited

U.S. PATENT DOCUMENTS

| | | | |
|---|---|---|---|
| 1,784,891 | 12/1930 | Dean et al. | 380/33 |
| 2,408,692 | 10/1946 | Shore | 380/34 |
| 3,777,064 | 12/1973 | Allen et al. | 380/39 |
| 4,398,216 | 8/1983 | Field et al. | 380/31 X |
| 4,433,211 | 2/1984 | McCalmont et al. | 380/36 |
| 4,525,844 | 6/1985 | Scheuermann | 380/38 |
| 4,551,580 | 11/1985 | Cox et al. | 380/36 |
| 4,652,699 | 3/1987 | Akaiwa | 380/31 |
| 4,747,137 | 5/1988 | Matsunaga | 380/9 X |
| 4,773,092 | 9/1988 | Huange | 380/9 |
| 4,802,219 | 1/1989 | Tjerlund | 380/39 |

*Primary Examiner*—Bernarr E. Gregory
*Attorney, Agent, or Firm*—Staas & Halsey

[57] ABSTRACT

Disclosed is a voice band splitting scrambler. To simplify the hardware thereof, the apparatus comprises a band splitting unit (11) for splitting an input voice signal into a plurality of band channels, and a scrambled voice signal generating unit (13) for carrying out spectrum-inverting and band-relocating operations on the respective channels to generate a scrambled voice signal. The scrambled voice signal generating unit (13) includes a modulating unit (15) for band-relocating the respective channels by noninverting carriers of inverting carriers set in different bands respectively; and an adding unit (17) for adding the signals of the noninverting channels and the signals of the inverted channels to each other.

26 Claims, 13 Drawing Sheets

①
f1
221
2.3
(kHz)

②
f2
222
2.9

③
f3
223
3.5

④
f4
224
4.1

⑤
f5
225
0
1.4
2
4.7
(kHz)

Fig. 14 PRIOR ART
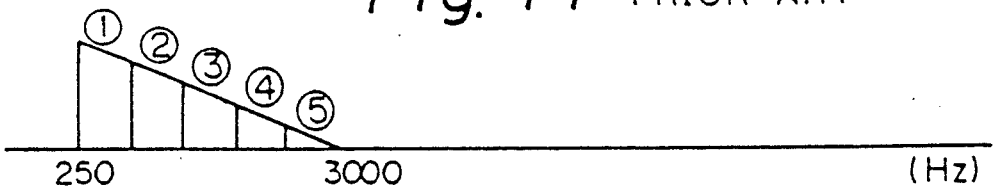
PRIOR ART
Fig. 16A
Fig. 16B
Fig. 16C
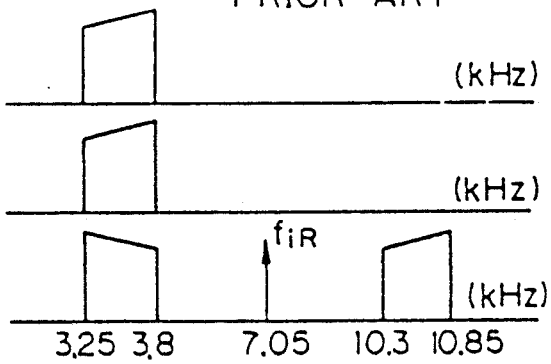
Fig. 18 PRIOR ART
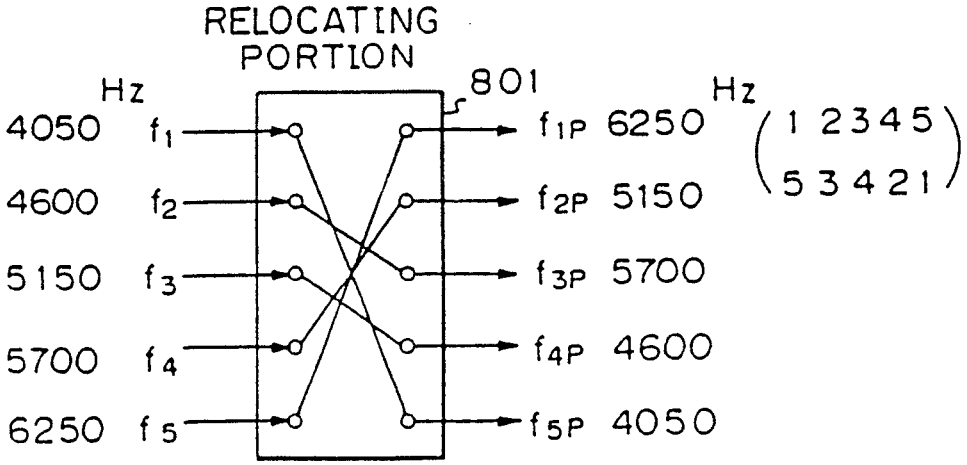

VOICE BAND SPLITTING SCRAMBLER

BACKGROUND OF THE INVENTION (1) Field of the Invention

The present invention relates to a voice band splitting scrambler or, in other words, a secret speech apparatus based on a band splitting and band relocating system. Particularly, the present invention relates to a band splitting scramlber (hereinafter, voice scrambler) having a constitution for collectively carrying out a spectrum inverting process of respective band-split channels to realize a simplification of the hardware.

(2) Description of the Related Arts

As a voice scrambler for realizing scrambled voice communications, an apparatus utilizing a band splitting and band relocation system is in practical use. This apparatus divides a speech frequency band into equal parts and relocates the divided parts. When relocating, the apparatus inverts and shifts predetermined bands.

As a conventional voice scrambler, the HW13 of the MARCONI Co. is known and disclosed in "Explanation of Scrambled Voice Apparatus", Suurikagaku (mathematical science), Dec., 1975.

This conventional apparatus has a disadvantage of a large amount of hardware or a construction containing too many elements, because the spectrum inverting process and the band relocating process of the split bands are carried out by separate elements, as later described in more detail with reference to the drawings.

SUMMARY OF THE INVENTION

An object of the present invention is to solve the problem of the conventional apparatus by providing a voice band splitting scrambler wherein the number of multipliers is reduced and thus the hardware is simplified.

To attain the above object, there is provided, according to the present invention, a voice band splitting scrambler which comprises a band splitting unit for splitting an input speech signal into a plurality of band channels; and a voice scrambling signal generating unit for carrying out spectrum-inverting and band-relocating operations on the respective channels to generate a voice scrambled signal.

The voice scrambling signal generating unit includes a modulating unit for band-relocating the respective channels according to noninverting carriers or inverting carriers that are set in different bands respectively; and an adding unit for adding signals of noninverted channels and signals of inverted channels to each other.

BRIEF DESCRIPTION OF THE DRAWINGS

The above object and features of the present invention will be more apparent from the following description of the preferred embodiments with reference to the drawings, wherein:

FIG. 14 is a view showing an example of an output spectrum of a bandpass filter ($BPF_{11}$) 603;

FIGS. 16A to 16C are views explaining noninverting and inverting processes of the prior art;

FIG. 18 is a view showing an example of a conventional band relocating portion; and, FIGS. 19A to 19G are views explaining the band relocating process and scrambled voice outputs of the prior art.

DESCRIPTION OF THE PREFERRED EMBODIMENTS

For a better understanding of the present invention, a conventional voice scrambler apparatus and the problems therein will be first described with reference to FIGS. 12 to 19.

FIGS. 12A and 12B are views explaining an outline of the band splitting and relocating system.

A speech frequency band (0.25 kHz to 3.0 kHz in a radio communication) is split by five into channels 1 to 5 each having a band width of 550 Hz.

Note that a speech frequency band in a telephone communication ranges from 0.3 kHz to 3.3 kHz. In this case, each of the five split band widths is 600 Hz. In the following description of the conventional device, the speech frequency band from 0.25 kHz to 3.0 kHz is used.

The channels are relocated in the order of $\bar{5}$, 3, $\bar{4}$, $\bar{2}$ and 1 to provide a scrambled voice signal, and the channels 2 (0.8 kHz to 1.35 kHz), 4 (1.9 kHz to 2.45 kHz) and 5 (2.45 kHz to 3.0 kHz) are spectrum-inverted.

Figure 13:
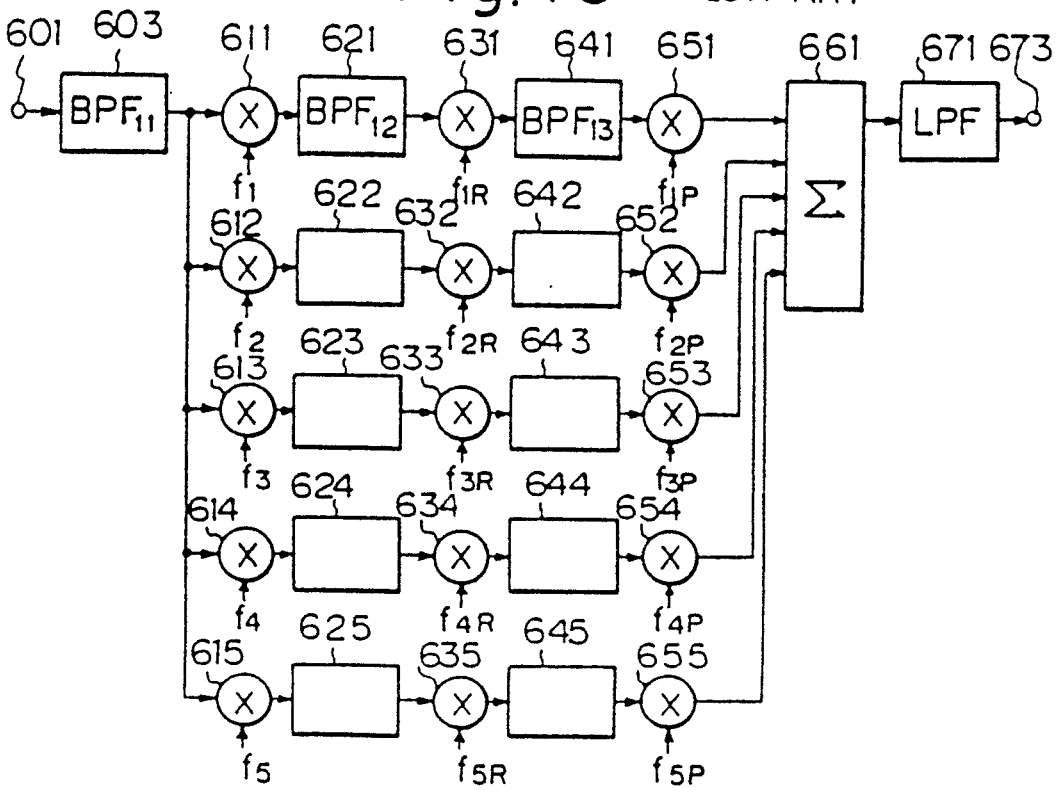
Fig. 13 PRIOR ART
FIG. 13 is a block diagram showing a constitution of a conventional voice band splitting scrambler.
Figures 15A, 15B, 15C, 15D, 15E:
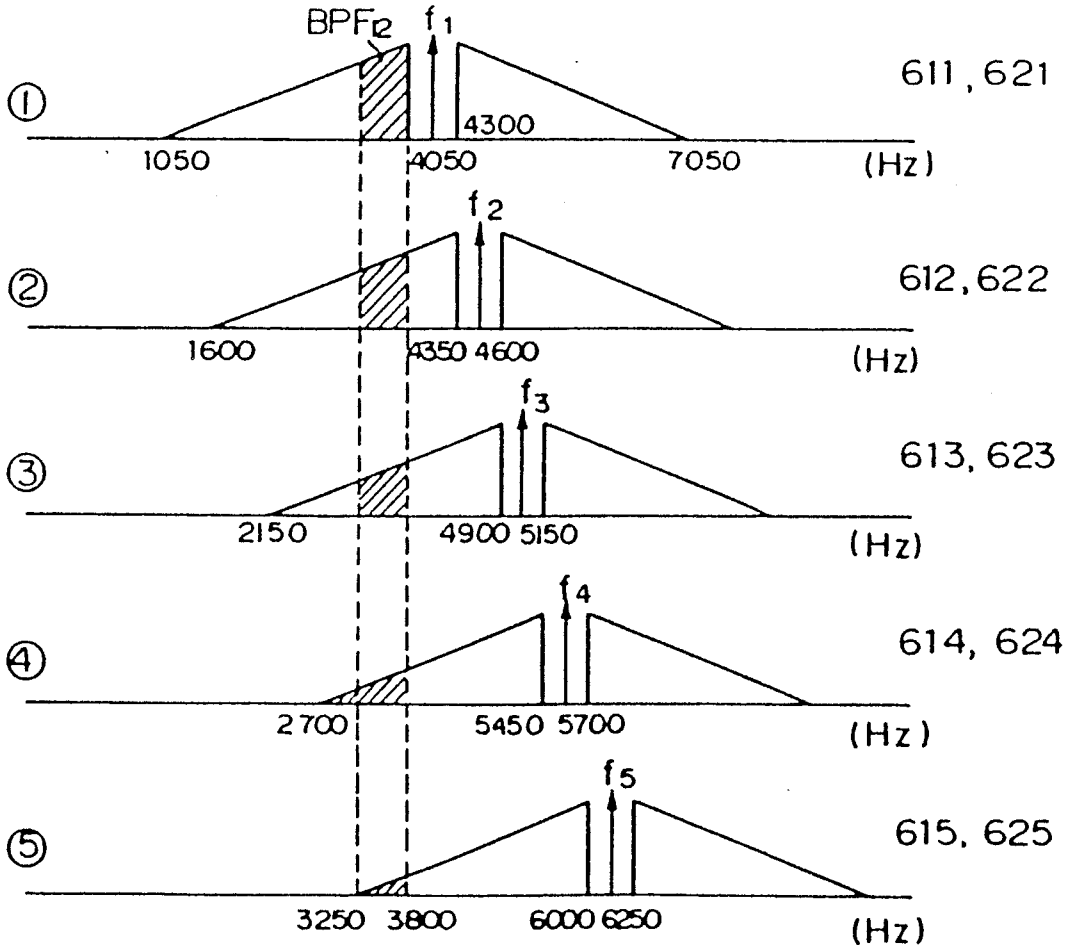
FIGS. 15A to 15E are views showing examples of output spectra of multipliers 611 to 615.
Figures 17A, 17B, 17C, 17D, 17E:
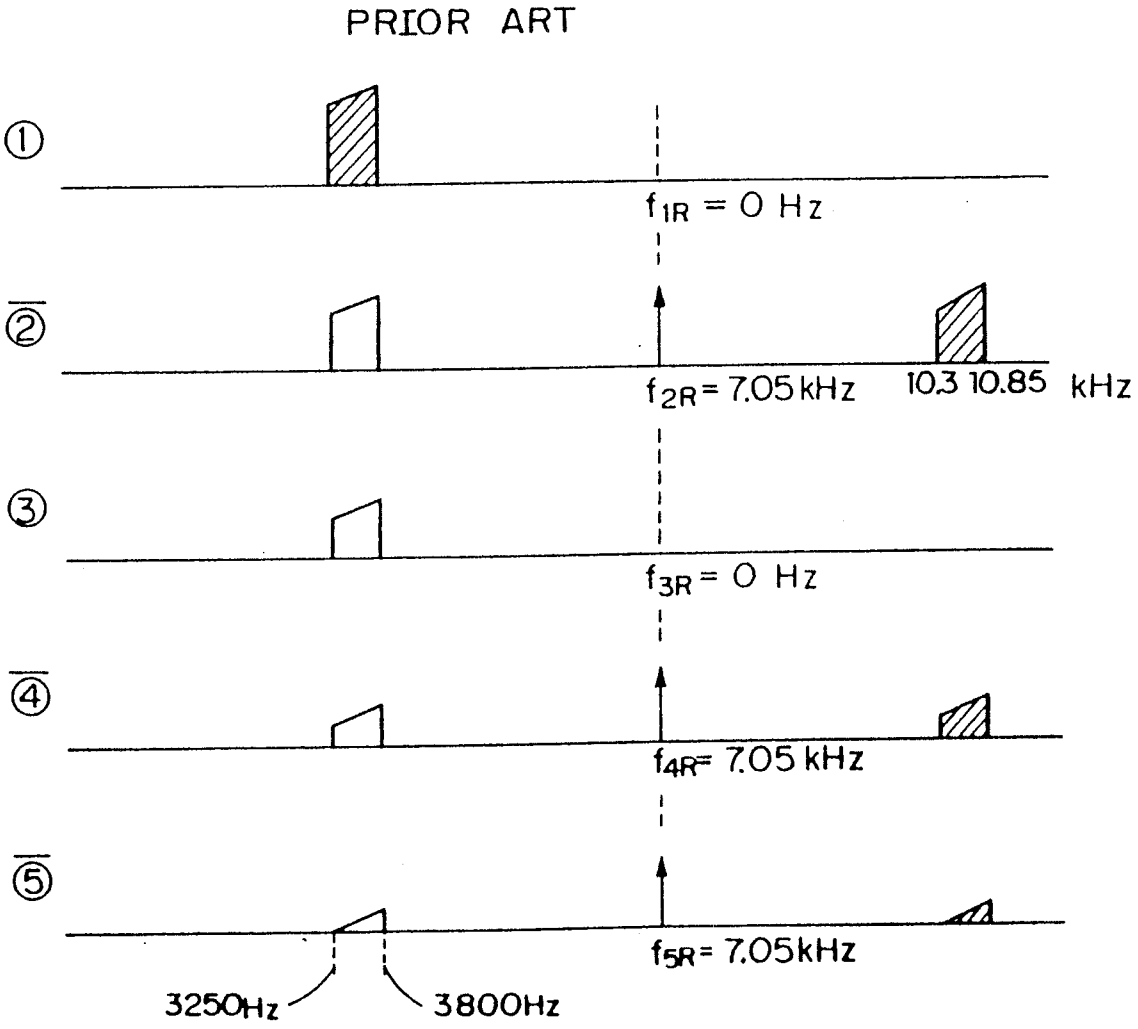
FIGS. 17A to 17E are views explaining the noninverting and the inverting processes of the prior art for each channel in more detail.

FIG. 13 is a block diagram showing an apparatus that realizes the band splitting and relocating system for splitting a speech frequency band into five channels and relocating the channels. The conventional example shown here is that disclosed as a scrambled voice apparatus HW13 of the MARCONI Co., ("Explanation of Scrambled Voice Apparatus", Suurikagaku (mathematical science), Dec., 1975).

In the figure, a voice signal input to an input terminal 601 is filtered by a bandpass filter ($BPF_{11}$) 603 to a frequency band from 250 Hz to 3000 Hz and input to multipliers 611 to 615 for channels 1 to 5. In the multipliers 611 to 615 corresponding to the respective channels, the filtered voice signal (250 Hz to 3000 Hz) is modulated with carriers $f_1$ (4050 Hz), $f_2$ (4600 Hz), $f_3$ (5150 Hz), $f_4$ (5700 Hz) and $f_5$ (6250 Hz), respectively. The channels are filtered to 3250 Hz to 3800 Hz with bandpass filters ($BPF_{12}$) 621 to 625. Signals of the respective bandlimited channels correspond to signals obtainable by splitting the voice signal, which has been band-limited by the bandpass filter 603, by five.

FIG. 14 is a view showing an example of the output spectrum of the bandpass filter 603. The voice signal is assumed to have a continuous spectrum in the frequency band of from 250 Hz to 3000 Hz.

FIGS. 15A to 15E are views showing examples of output spectra of the multipliers 611 to 615 corresponding to the respective channels. In the respective channels, the voice signal (250 Hz to 3000 Hz) is modulated by the carriers $f_1$ to $f_5$. For example, in the channel 1, the signal is modulated with the carrier $f_1$ (4050 Hz) in the multiplier 611 to form a lower sideband from 1050 (4050−3000) Hz to 3800 (4050−250)Hz and an upper sideband from 4300 (4050+250) Hz to 7050 (4050+3000) Hz. Other channels are processed in a similar way.

Hatched portions in the lower sidebands indicate output spectra of the bandpass filters 621 to 625.

The outputs of the bandpass filters 621 to 625 are inverted by multipliers 631 to 635 and bandpass filters ($BPF_{13}$) 641 to 645. Namely, with respect to the channels i (i=1 to 5), carriers (frequencies $f_{iR}$) of direct current components ($f_{iR}=0$ Hz) are input to the direct multipliers 631 to 635 for a non-inversion process, and those of sin waves are input for an inversion process.

FIG. 16A is a view showing an example of an output spectrum of one of the bandpass filters 621 to 625. With respect to this output spectrum, FIG. 16B is a view showing an output spectrum of one of the multipliers 631 to 635 for the noninverting process ($f_{iR}=0$ Hz), and FIG. 16C is a view showing an output spectrum of one of the multipliers 631 to 635 for the inversion process ($f_{iR}=7.05$ kHz).

Figure 12:
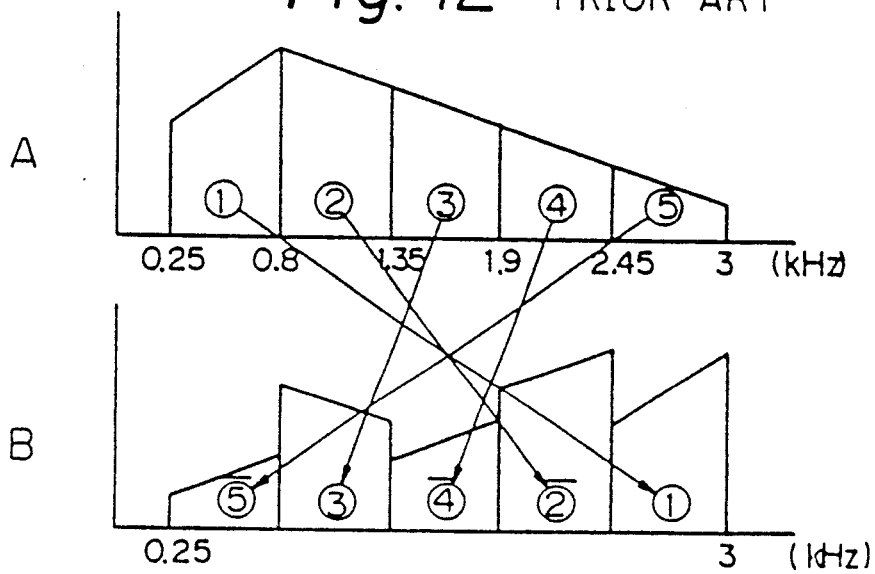
Fig. 12 PRIOR ART
FIGS. 12A and 12B are views explaining schematically a band splitting and relocating system.

Accordingly, to obtain the noninverted channels 1 and 3 and the inverted channels 2, 4 and 5 as shown in FIG. 12, as an example, it is sufficient to supply the carrier frequencies $f_{2R}$, $f_{4R}$ and $f_{5R}$ equal to 7.05 kHz, while the carrier frequencies $f_{1R}$ and $f_{3R}$ are set to 0 Hz, as shown in FIGS. 17A to 17E.

After the noninverting process or inverting process, the signals are filtered by bandpass filters 641 to 645 to a frequency band from 3.25 kHz to 3.8 kHz, and therefore, an upper sideband (10.3 kHz to 10.85 kHz) at the time of inversion process is blocked.

The signals are then modulated by multipliers 651 to 655 to required bands and relocated. The relocating process is carried out by properly combining the carriers $f_1$ (4050 Hz), $f_2$ (4600 Hz), $f_3$ (5150 Hz), $f_4$ (5700 Hz) and $f_5$ (6250 Hz) and assigning them to $f_{ip}$ (i=1 to 5). Then, the signals of the respective channels are modulated to a base band (250 Hz to 3000 Hz), and synthesized in an adder 661.

FIG. 18 is a view showing an example of combination of the carriers $f_i$ of the multipliers 611 to 615 and the carriers $f_{ip}$ of the multipliers 651 to 655.

The combination is determined according to a predetermined logic in a relocating portion 801.

By the example shown in FIG. 18, the relocated channels from the low frequency band to the high frequency band are the original channels 5, 3, 4, 2, and 1.

FIGS. 19A to 19E are views showing output spectra of signals relocated (or modulated) by the multipliers 651 to 655.

Figures 19A, 19B, 19C, 19D, 19E, 19F, 19G:
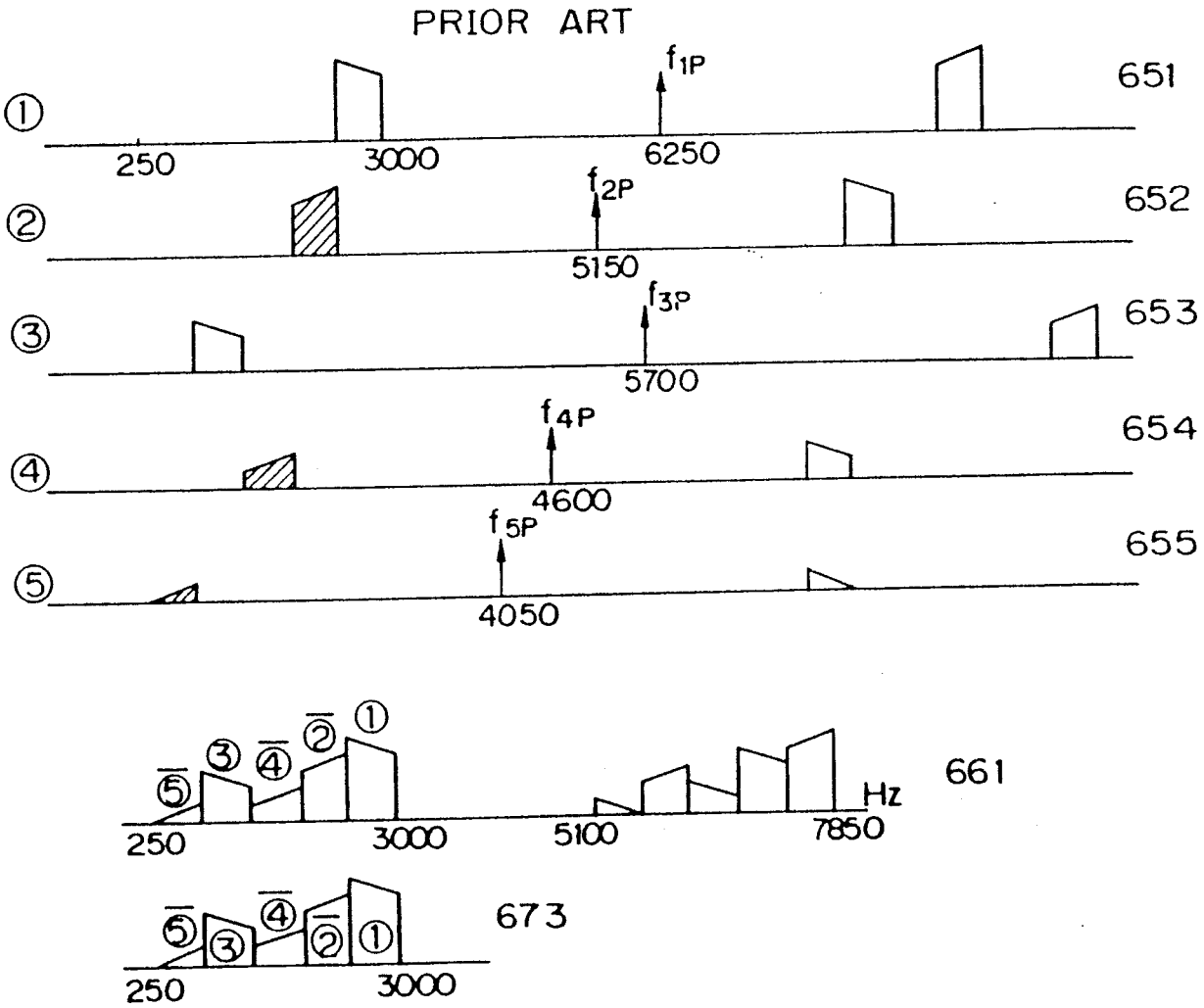

FIG. 19F is a view showing output spectra of signals added by the adder 661.

FIG. 19G is a view showing an output spectrum of signals added in the adder 661 according to the assignment.

The channels 2, 4 and 5 are inverted in the multipliers 632, 634 and 635 and the bandpass filters 642, 644 and 645, respectively.

A low-pass filter 671 blocks an upper sideband (5100 Hz to 7850 Hz) of the signals which have been modulated by the multipliers 651 to 655 and added to each other by the adder 661, and outputs a lower sideband (250 Hz to 3000 Hz) of the signals as a scrambled voice signal to an output terminal 673.

As described above, according to the conventional voice scrambler apparatus, the inversion and relocation processes of the spectra of split bands are carried out separately by using the multipliers 631 to 635 and 651 to 655, and thus a problem arises in that the number of components including the bandpass filters 641 to 645 for blocking an upper sideband at the time of inversion process is increased.

Further, because the carrier frequencies for inversion and relocating process are too high, the number of poles of the bandpass filters in the conventional system is so large that it is difficult to obtain sharp cut off characteristics of the bandpass filters.

Embodiments of the present invention will now be described.

Figure 1:
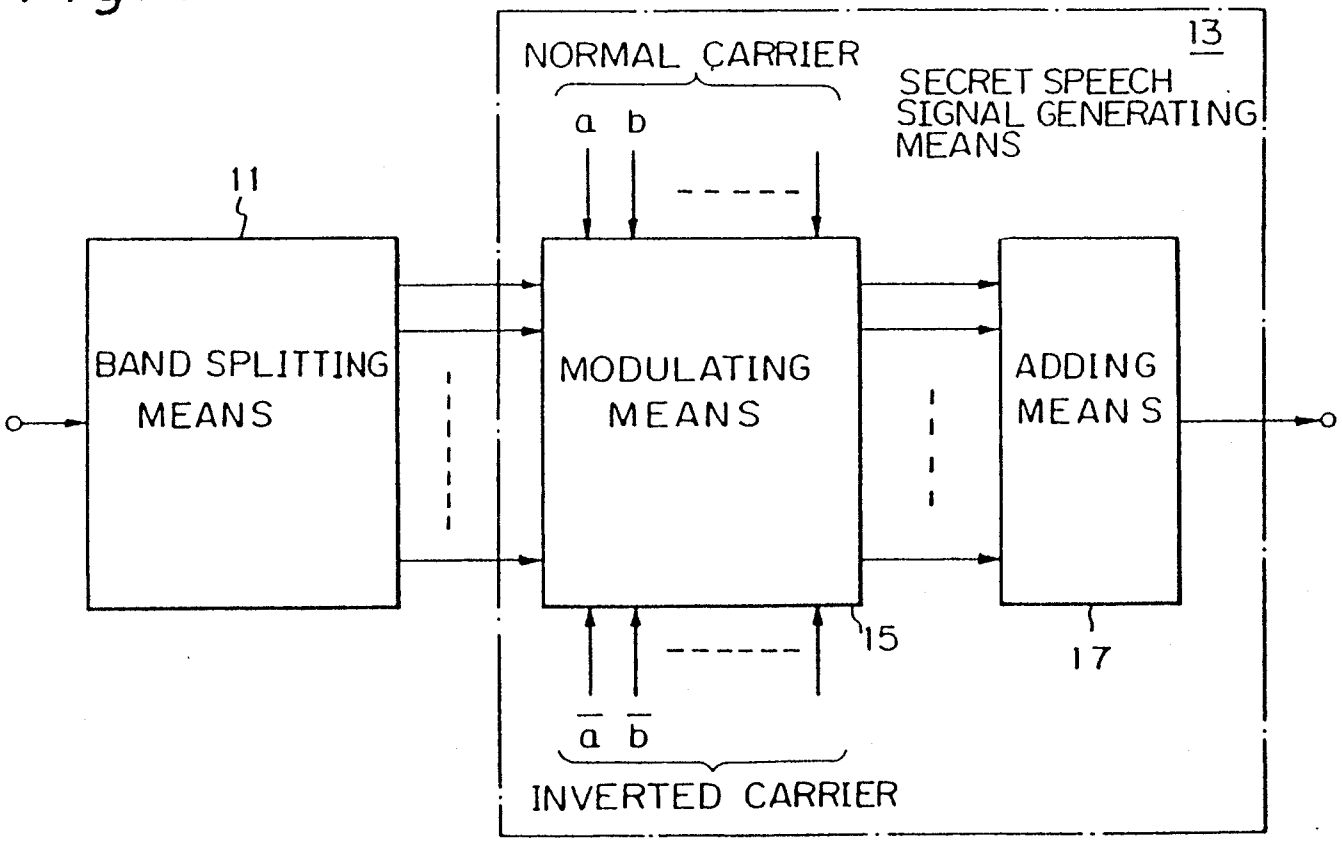
FIG. 1 is a block diagram showing a principle of an embodiment of the present invention.

FIG. 1 is a block diagram showing a principle of an embodiment of the present invention.

In the figure, a band splitting unit 11 splits an input voice signal into a plurality of band channels.

A modulating unit 15 relocates the bands of respective channels by the use of noninverting carriers or inverting carriers that are set in different bands respectively.

An adding unit 17 adds the signals of the noninverted channels and signals of the inverted channels to each other.

The modulating unit 15 and the adding unit 17 form a scrambled voice signal generating unit 13 for performing spectrum-inverting and band-relocating operations with respect to the respective channels to generate a scrambled voice signal.

Preferably, the adding unit 17 includes an adding device for adding the signals of noninverted channels to each other and adding the signals of inverted channels to each other, and a device for modulating at least one of the added signals and adding the signals of both of the channels to form a continuous spectrum.

Alternatively, preferably the noninverting carriers and inverting carriers are set such that the band of an upper sideband of a signal modulated by one of the carriers coincides with the band of a lower sideband of a signal modulated by the other of the carriers.

In operation, the modulating unit 15 relocates the bands of respective channels with the noninverting carriers or the inverting carriers which are set in the different bands respectively. The adding unit 17 adds the signals of the noninverted channels and the signals of the inverted channels to each other, and as a result, the signals of the noninverted channels and the signals of the inverted channels are collectively processed, thus allowing a reduction of the number of multipliers conventionally needed for the spectrum inverting process.

For example, by adding the noninverted channel signals to each other and adding the inverted channel signals to each other, and by modulating at least one of the added signals such that a continuous spectrum is formed when the one added signal is added to the other added signal, a collective process of the noninverted channel signals and the inverted channel signals is realized.

Alternatively, the noninverted carriers and inverted carriers are set such that the band of an upper sideband of a signal modulated by one of the carriers coincides with the band of a lower sideband of a signal modulated by the other of the carriers. By adding signals of the noninverted channels and signals of inverted channels to each other, the band-relocating process and the spectrum-inverting process can be performed simultaneously.

Figure 2:
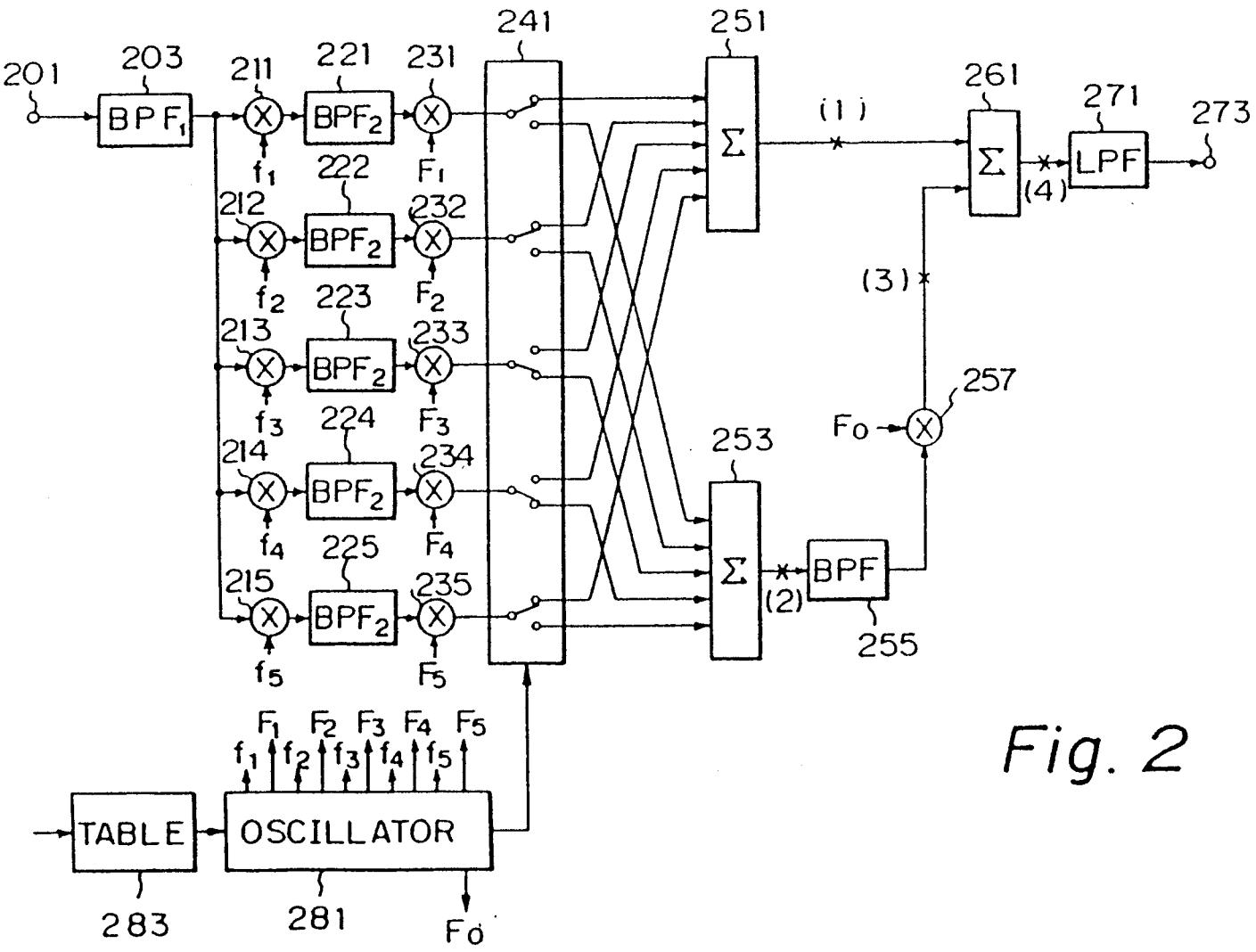
FIG. 2 is a block diagram showing a detailed constitution of the first embodiment of the present invention.

FIG. 2 is a block diagram showing a detailed constitution of the first embodiment of the present invention.

A voice signal input to an input terminal 201 is input to multipliers 211 to 215 through a bandpass filter ($BPF_1$) 203. Carriers $f_1$ to $f_5$ having different frequencies respectively are input to the multipliers 211 to 215, and multiplied by the band-limited voice signal. The outputs of the multipliers 211 to 215 are input to multipliers 231 to 235 through bandpass filters ($BPF_2$) 221 to 225, respectively, and carriers $F_1$ to $F_5$ having different frequencies respectively are input to the multipliers 231 to 235, for multiplication. The outputs of the multipliers 231 to 235 are input to an adder 251 or an adder 253 through a switching circuit 241, an output of the adder 253 is input into a multiplier 257 through a bandpass filter ($BPF_3$) 255, an output multiplied by a carrier $F_0$ of the multiplier 257 is input together with an output of the adder 251 into an adder 261, and an output of the adder 261 is sent to an output terminal 273 through a low-pass filter (LPF) 271.

An oscillator 281 selects predetermined frequencies according to set values of a table 283 to send the carriers to the multipliers 211 to 215, 231 to 235 and 257 as well as sending a switching control signal to the switching circuit 241.

The band splitting unit 11 in the block diagram shown in FIG. 1 showing the principle of the embodiment of the present invention includes the bandpass filter 203, multipliers 211 to 215, and bandpass filters 221 to 225 in FIG. 2. Similarly, the modulating means 15 includes the multipliers 231 to 235, oscillator 281, and table 283, and the adding unit 17 includes the switching circuit 241, adders 251 and 253, bandpass filter 255, multiplier 257, and adder 261.

Figure 3A:
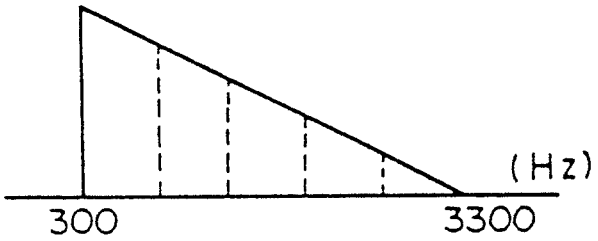
FIGS. 3A to 3C are views explaining the relationships of carrier frequencies and multiplier outputs.

In this embodiment, an explanation will be made for a case in which a voice signal band-limited in the bandpass filter 203 to a band from 300 Hz to 3300 Hz is split by five (a band of each channel being 600 Hz) (FIG. 3A)

It is, of course, possible to split a band from 250 Hz to 3000 Hz as shown in FIG. 12.

The multipliers 211 to 215 corresponding to the respective channels modulate the voice signal (300 Hz to 3300 Hz) with the carriers $f_1$ to $f_5$. The respective channels of the modulated signal are filtered through the bandpass filters 221 to 225 so that the bands of the respective channels are properly arranged.

The number of poles of the bandpass filters 221 to 225 may be reduced by reducing the center frequencies of the filters, if the filters have the same characteristics. Therefore, by setting the carrier frequencies of the multipliers 211 to 215 low enough that the outputs of the bandpass filters are not distorted due to reflected signal components which are called as an "aliasing" noise, the number of the poles of the bandpass filters 221 to 225 may be reduced.

Figure 3B:
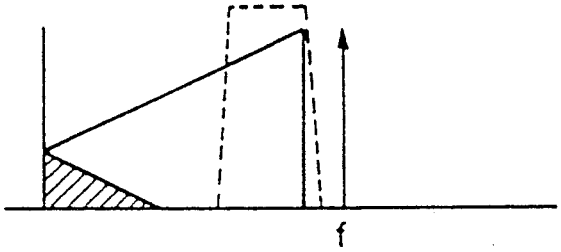
Figure 3C:
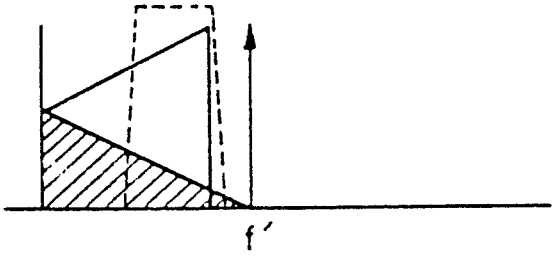

FIGS. 3B and 3C are views explaining the relationships between a carrier frequency and a multiplier output with respect to the voice signal (an output of the bandpass filter 203 of FIG. 3A).

In the figures, hatched portions represent aliasing noise components. When the multiplier output is filtered with a bandpass filter to a predetermined band, deterioration due to aliasing distortion occurs if a carrier frequency f' is low, as shown in FIG. 3C, and therefore, an optimum carrier frequency f is determined as shown in FIG. 3B.

According to this embodiment, carrier frequencies of the multipliers 211 to 215 are set as $f_1=2.3$ kHz, $f_2=2.9$ kHz, $f_3=3.5$ kHz, $f_4=4.1$ kHz and $f_5=4.7$ kHz, and passbands of the bandpass filters 221 to 225 are set from 1.4 kHz to 2.0 kHz.

In this way, by setting the carriers $f_1$ to $f_5$ as low as possible, the center frequencies of the bandpass filters 221 to 225 may be lowered. Therefore, compared to the conventional system, if elliptic characteristics are used, two poles of the bandpass filters 221 to 225 may be omitted, thereby reducing the hardware. In the figure, hatched portions represent bandpass filter outputs corresponding to the respective channels 1 to 5.

In the multipliers 231 to 235, the respective channels are modulated with the predetermined carriers $F_1$ to $F_5$ and then band-relocated.

In this embodiment, for the spectrum inversion and non-inversion processes of the respective channels, nonnverting carriers and inverting carriers having different frequencies are used in the combinations shown in Table 1.

In Table 1, the noninverting carriers a (2.3 kHz) to e (4.7 kHz) are selected when the lower sidebands produced by the noninverting carriers are used for forming a noninverted scrambled voice signal; and the inverting carriers $\bar{a}$ (5.8 kHz) to $\bar{e}$ (8.2 kHz) are selected when the upper sidebands produced by the inverting carriers are used for forming an inverted scrambled voice. The frequencies of the inverting carriers are determined such that the higher harmonics produced by the noninverting carriers do not overlap the upper sidebands produced by the inverting carriers.

Table 2 shows examples of frequencies of the carriers $F_1$ to $F_5$ corresponding to the channels respectively, particularly without band-relocation.

Marks $\bar{c}$ and $\bar{d}$ represent inverting carriers. When the inverting carriers are used, the upper sidebands of the modulated signals are selected for forming scrambled signals.

TABLE 1

| Non-Inverting | kHz | Inverting | kHz |
|---|---|---|---|
| a | 2.3 | $\bar{a}$ | 5.8 |
| b | 2.9 | $\bar{b}$ | 6.4 |
| c | 3.5 | $\bar{c}$ | 7.0 |
| d | 4.1 | $\bar{d}$ | 7.6 |
| e | 4.7 | $\bar{e}$ | 8.2 |

TABLE 2

| Carriers for channels | | (kHz) |
|---|---|---|
| $F_1$ | a | (2.3) |
| $F_2$ | b | (2.9) |
| $F_3$ | c | (7.0) |
| $F_4$ | d | (7.6) |
| $F_5$ | e | (4.7) |

The band-relocating and inverting processes can be carried out by setting the carriers $F_1$ to $F_5$ to any one of frequencies a ($\bar{a}$) to e ($\bar{e}$).

The switching circuit 241 connects outputs of the multipliers 231, 232, and 235 corresponding to the channels 1, 2, and 5 to the adder 251 for the noninverting process while connecting outputs of the multipliers 233 and 234 corresponding to the channels 3 and 4 to the adder 253 for the inversion process.

FIGS. 5A to 5D are views corresponding to Table 2 and explaining signal spectra after the adders 251 and 253.

Figure 5A:
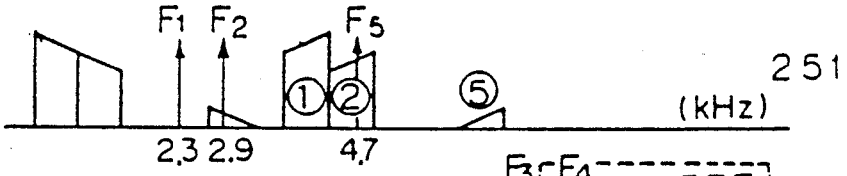
FIGS. 5A to 5D are views explaining signal spectra corresponding to Table 2.
Figure 5B:
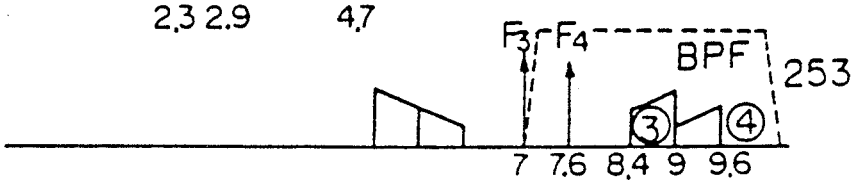
Figure 5C:
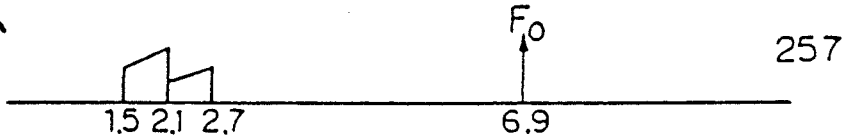
Figure 5D:
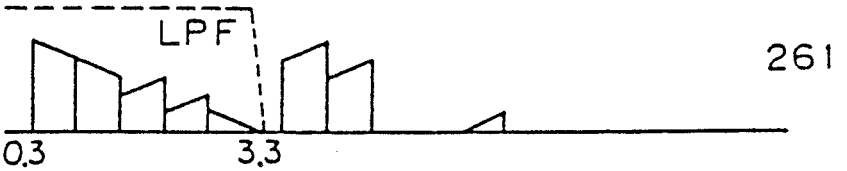

FIG. 5A shows an output of the adder 251, FIG. 5B an output of the adder 253, FIG. 5C an output of the multiplier 257 (an upper sideband (15.3 kHz to 16.5 kHz) of the channels 3 and 4 omitted), and FIG. 5D an output of the adder 261.

The output (FIG. 5B) of the adder 253 for the inversion process is input to the bandpass filter 255 in which the output is band-limited to 7.2 kHz to 10.2 kHz corresponding to an upper sideband of output signals modulated by the multipliers 231 to 235 (233 and 234 in this example) with inverted carriers $\bar{a}$ (5.8 kHz) to $\bar{e}$ (8.2 kHz) ($\bar{c}$ and $\bar{d}$ in this example), and then modulated to a base band by the multiplier 257 with a carrier $F_0$ (6.9 kHz) (FIG. 5C).

The adder 261 adds the output of the multiplier 257 (the added output (FIG. 5C) of the inverted channels) to the output of the adder 251 for the noninverting process (the added output (FIG. 5A) of the noninverted channels).

The output of the adder 261 (FIG. 5D) is filtered by the low-pass filter 271 and output as a required scrambled voice signal from the output terminal 273.

In the above description with reference to the Tables 1 and 2 and FIGS. 5A to 5D, the inverting carriers of higher frequencies are employed to avoid adverse influences due to the higher harmonics produced by the noninverting carriers of the lower frequencies. The higher frequencies of the inverting carriers are necessary when the multipliers 231 to 235 are formed by simple ring modulators, because the higher harmonics of the modulated signals produced by the noninverting carriers may overlap the upper sidebands, i.e., the inverted bands of the modulated signals produced by the inverting carriers, if the inverting carriers are determined to be nearly equal to the noninverting carriers.

Nevertheless, when the multipliers 231 to 235 are formed by generally known analog multipliers, it is possible to make the frequencies of the inverting carriers the same as the frequencies f the noninverting carriers. In this case, also, the inverted signals are selected from the upper sidebands of the signals modulated by the carriers, and the noninverted signals are selected from the lower sidebands thereof.

When the frequencies of the inverting carriers are the same as those of the noninverting carriers, the carrier table will be as shown in Table 1a.

TABLE 1a

| Non-Inverting kHz | | Inverting kHz | |
|---|---|---|---|
| a | 2.3 | $\bar{a}$ | 2.3 |
| b | 2.9 | $\bar{b}$ | 2.9 |
| c | 3.5 | $\bar{c}$ | 3.5 |
| d | 4.1 | $\bar{d}$ | 4.1 |
| e | 4.7 | $\bar{e}$ | 4.7 |

Comparing Table 1a with Table 1, it can be seen that the number of carrier frequencies in Table 1a is half that in Table 1.

Instead of inverting the channels 3 and 4, when the channels 2, 4 and 5 are to be inverted as in the conventional example shown in FIG. 19, the switching circuit 241 connects the outputs of the multipliers 231 and 233 corresponding to the channels 1 and 3 to the adder 251 for the noninverting process while connecting outputs of the multipliers 232, 234 and 235 corresponding to the channels 2, 4 and 5 to the adder 253 for the inversion process. In this case, and when carriers are selected from the Table 1a, the Table 2 should be changed so that the frequencies of the carriers $F_2$, $F_4$ and $F_5$ are $\bar{d}$ (4.1), $\bar{c}$ (3.5) and $\bar{a}$ (2.3) kHz. The Table 2 for this case is Table 2a, shown below. In this case also, marks $\bar{d}$, $\bar{c}$ and $\bar{a}$ represent inverting carriers.

TABLE 2a

| Carriers for channels | | kHz |
|---|---|---|
| $F_1$ | $\bar{e}$ | (4.7) |
| $F_2$ | d | (4.1) |
| $F_3$ | $\bar{b}$ | (2.9) |
| $F_4$ | $\bar{c}$ | (3.5) |
| $F_5$ | a | (2.3) |

Figures 4A, 4B, 4C, 4D, 4E:
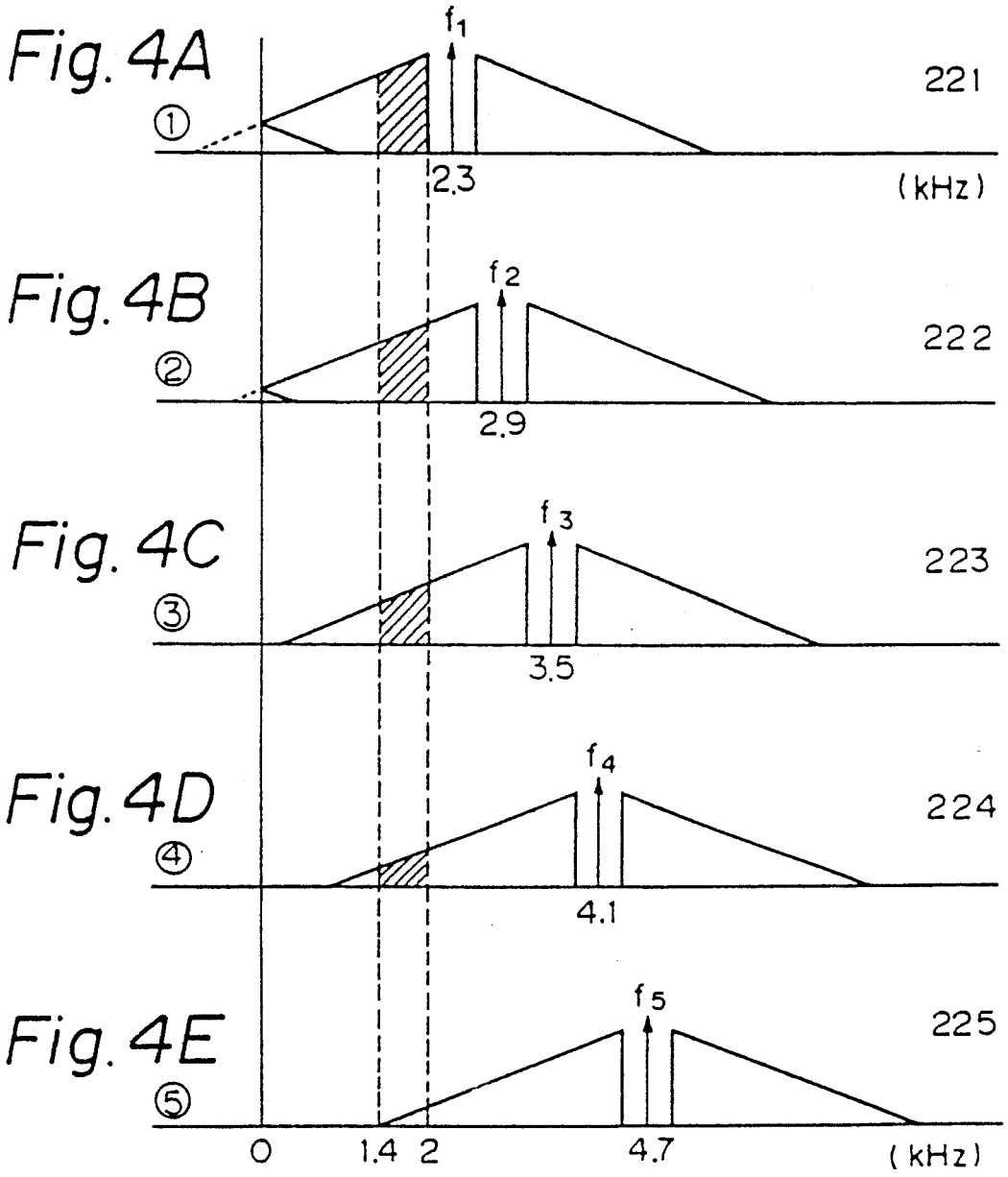
FIGS. 4A to 4E are views showing an example of band splitting process for reducing the order of a bandpass filter ($BPF_2$)
Figure 6A:
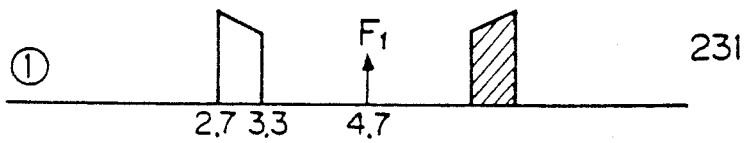
FIGS. 6A to 6E are views corresponding to Table 2a for explaining signal spectra at the outputs of the multiplexers 231 to 235.
Figure 6B:
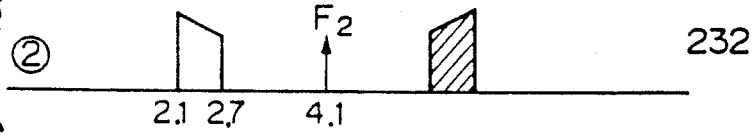
Figure 6C:
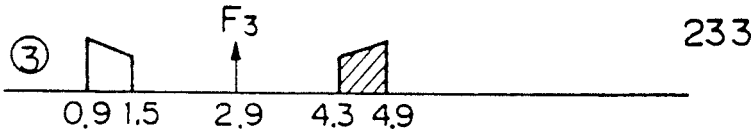
Figure 6D:
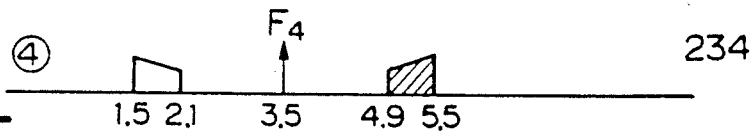
Figure 6E:
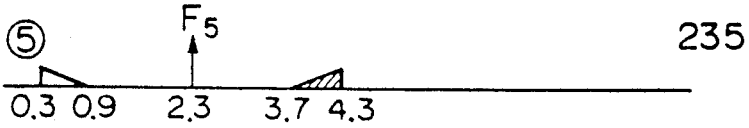

FIGS. 6A to 6E are views corresponding to Table 2a and explaining signal spectra at the outputs of the multiplexers 231 to 235. As shown in FIG. 6A, the hatched portion shown in FIG. 4A, which is the frequency band obtained by bandpass filter ($BPF_2$) 221, is modulated by the multiplier 231 with the carrier frequency $F_1$ (4.7 kHz) so that a noninverted lower sideband from 2.7 kHz to 3.3 kHz and an inverted upper sideband from 7.1 kHz to 7.7 kHz are obtained. The inverted upper sideband is illustrated by hatching. Similarly, the channels 2, 3, and 5 are modulated by the multipliers 231 to 235 with the carrier frequencies $F_2$ (4.1 kHz), $F_3$ (2.9 kHz), $F_4$ (3.5 kHz), and $F_5$ (2.3 kHz) respectively.

FIGS. 7A to 7E are views corresponding to Table 2a and explaining signal spectra after the adders 251 and 253.

Figure 7A:
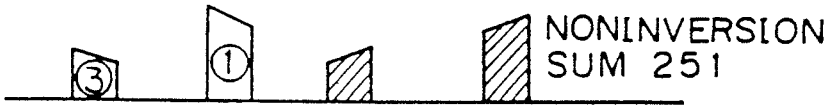
FIGS. 7A to 7E are views corresponding to Table 2a for explaining signal spectra after the adders 251 and 253.
Figure 7B:
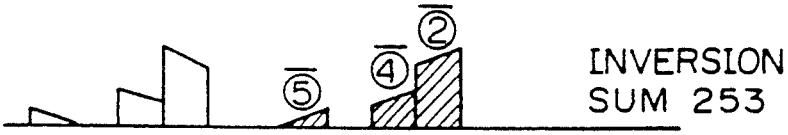
Figure 7C:
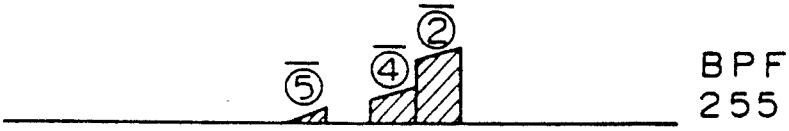
Figure 7D:
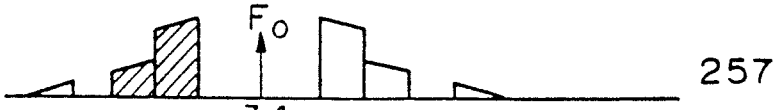
Figure 7E:
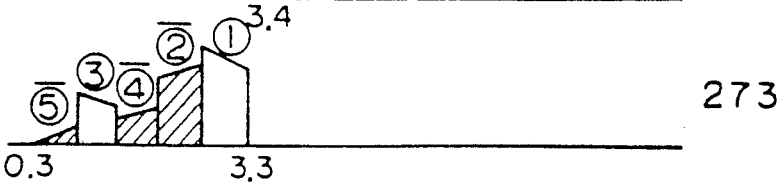

FIG. 7A shows an output of the adder 251; FIG. 7B an output of the adder 253; FIG. 7C an output of the bandpass filter 255; FIG. 7D an output of the multiplexer 257; and FIG. 7E an output of the adder 261. As can be seen from FIG. 7C, the bandpass filter (BPF}257 passes the upper sideband of the output of the adder 253 so that only the inverted sidebands 2, 4, and 5 are obtained and the lower sidebands 2, 4, and 5 are deleted. The inverted sidebands are then modulated by the multiplier 257 with a carrier $F_0$ (3.4 kHz) so that the inverted sidebands are relocated from the frequency band ranging from 4.2 kHz to 6.6 kHz to the frequency band ranging from 0.3 kHz to 2.6 kHz, as shown in FIG. 7D.

As described above, it will be apparent that, compared to the conventional constitution in which a spectrum inverting process and a spectrum relocating process for each channel are performed separately, the embodiment of the present invention simplifies the constitution of the multipliers, etc., by separately synthesizing the noninverted channels and the inverted channels and collectively performing an inverting process to synthesize a voice scrambled signal when the band relocating process is effected.

The inverting carrier frequency combination shown in Table 1 is for using an upper sideband of the added output of the inverted channels (FIG. 5B). The noninverting carrier combination is for using a lower sideband.

Table 3 shows an example of combination of the same frequencies as shown in Table 1 for noninverting carriers and different frequencies for using the lower sideband of the added output of the inverted channel. Namely, the arrangement of the inverting carriers is opposite to the arrangement shown in Table 1.

Table 4 shows examples of frequencies of the carriers $F_1$ to $F_5$ corresponding to the channels, particularly without band relocation. Marks $\bar{c}$ and $\bar{d}$ represent inverting carriers respectively.

TABLE 3

| | Non-inverting kHz | Inverting kHz |
|---|---|---|
| a | 2.3 | 8.2 |
| b | 2.9 | 7.6 |
| c | 3.5 | 7.0 |
| d | 4.1 | 6.4 |
| e | 4.7 | 5.8 |

TABLE 4

| Carriers for channels | | (kHz) |
|---|---|---|
| $F_1$ | a | (2.3) |
| $F_2$ | b | (2.9) |
| $F_3$ | c | (7.0) |
| $F_4$ | d | (6.4) |
| $F_5$ | e | (4.7) |

FIG. 8A to 8D are views corresponding to Table 4 and explaining signal spectra after the adders 251 and 253.

Figure 8A:
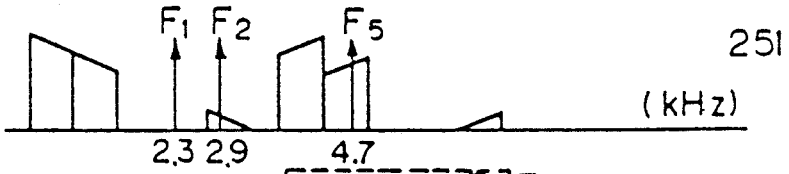
FIGS. 8A to 8D are views explaining signal spectra corresponding to Table 4.
Figure 8B:
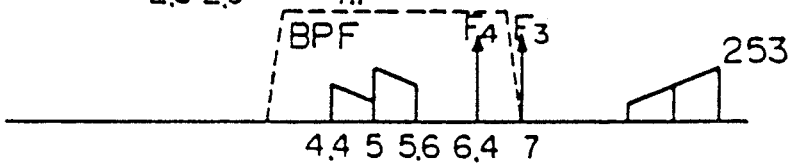
Figure 8C:
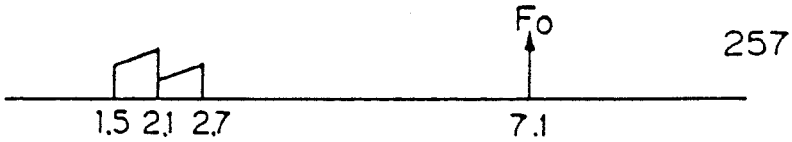
Figure 8D:
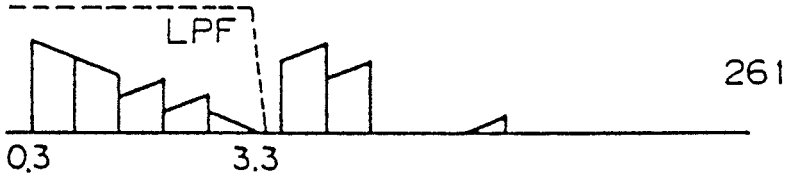

FIG. 8A shows an output of the adder 251, FIG. 8B an output of the adder 253, FIG. 8C an output of the multiplier 257 (an upper sideband (11.5 kHz to 12.7 kHz) of the channels 3 and 4 omitted), and FIG. 8D an output of the adder 261.

The output (FIG. 8B) of the adder 253 for the inverting process is input to the bandpass filter 255 in which the output is band-limited to 3.8 kHz to 6.8 kHz corresponding to a lower sideband of output signals modulated in the multipliers 231 to 235 with inverting carriers $\bar{a}$ (8.2 kHz) to $\bar{e}$ (5.8 kHz), and then modulated to a base band by the multiplier 257 with a carrier $F_0$ (7.1 kHz) (FIG. 8C).

Similarly, the adder 261 adds the output of the multiplier 257 (the added output (FIG. 8C) of the inverted channels) to the output of the noninverting process adder 251 (the added output (FIG. 8A) of the normal channels). The added output (FIG. 8D) is filtered by the low-pass filter 271 and output as a required voice scrambled signal from the output terminal 273. In the combinations of carrier frequencies shown in Tables 1 and 3, for example, an inverting carrier band may be set optionally (from 5.8 kHz to 8.2 kHz in tables 1 and 3). By properly adjusting the carrier $F_0$ of the multiplier 257, the noninverted and inverted channels can be synthesized. Here, to simplify the constitution of the oscillator 281, a part of the inverting carriers is set to a frequency which is double the frequency of a noninverting carrier.

By using the multipliers 211 to 215, 231 to 235 and 257 having proper circuit constitutions, an inversion process at a relatively low frequency will be realized. In this case, inverting carriers are not particularly necessary and the same process may be carried out only with the switching circuit 241, to generate the voice scrambled signal.

Figure 9A:
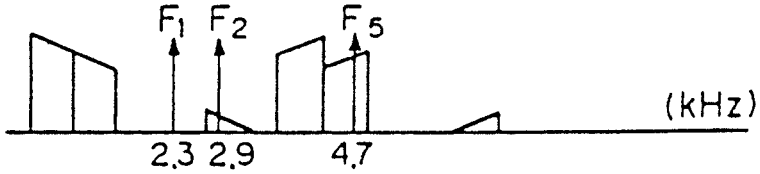
FIGS. 9A to 9D are views explaining a process in which no inverted carriers are prepared.
Figure 9B:
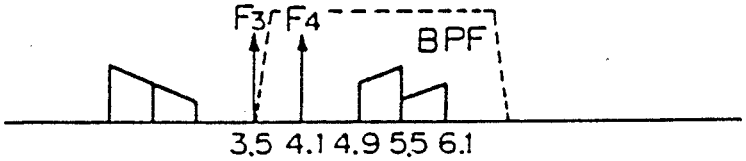
Figure 9C:
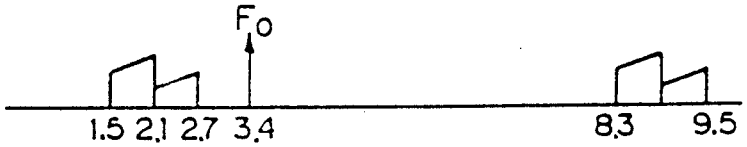
Figure 9D:
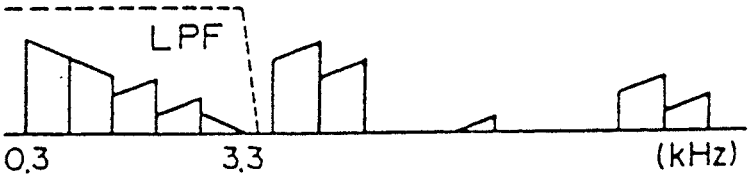

FIGS. 9A to 9D are views explaining a process in which inverting carriers are not used. FIG. 9A shows an output of the adder 251, FIG. 9B an output of the adder 253, FIG. 9C an output of the multiplier 257, and FIG. 9D an output of the adder 261.

In this case, the carrier $F_0$ of the multiplier 257 is 3.4 kHz.

Figure 10:
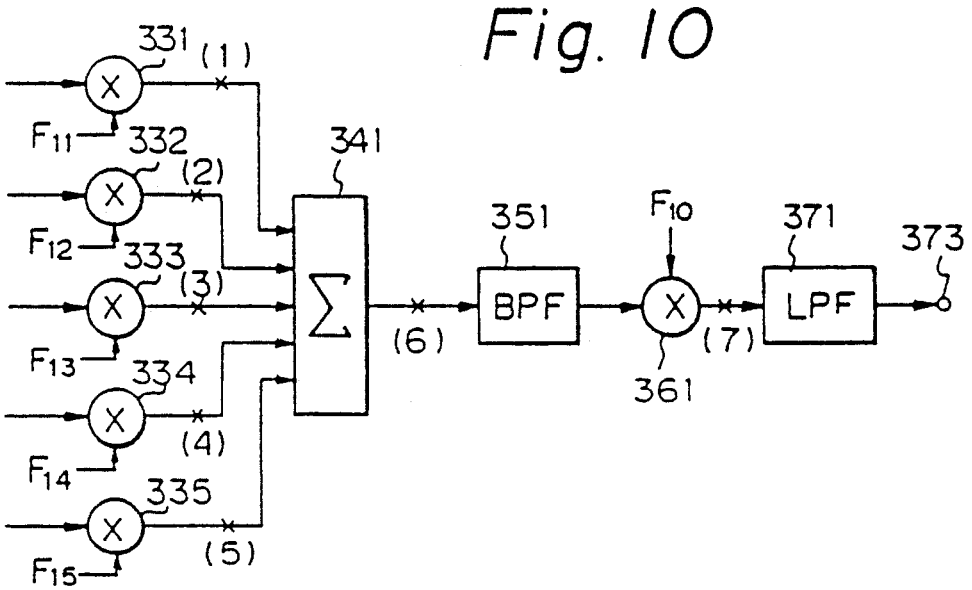
FIG. 10 is a block diagram showing a constitution of a second embodiment of the present invention.
Figure 11A:
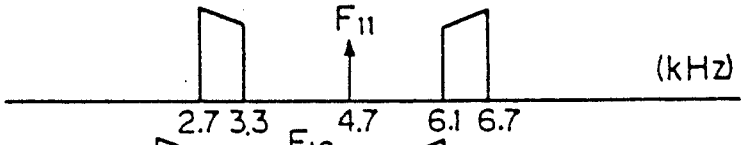
FIGS. 11A to 11G are views explaining signal spectra corresponding to Table 6.
Figure 11B:
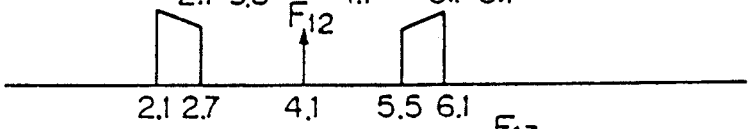
Figure 11C:
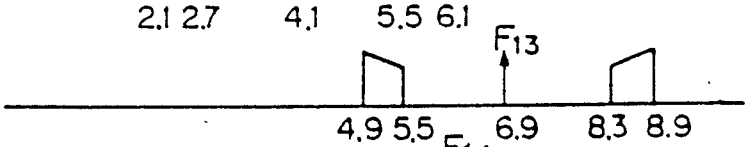
Figure 11D:
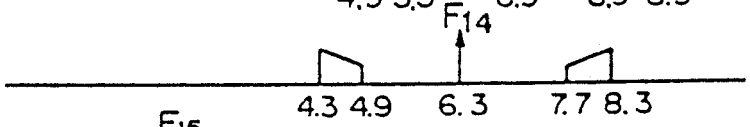
Figure 11E:
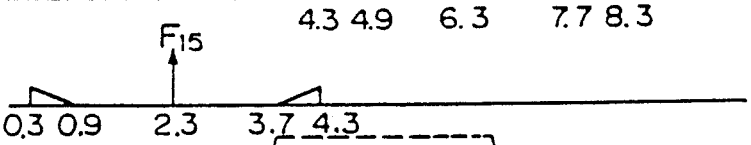
Figure 11F:
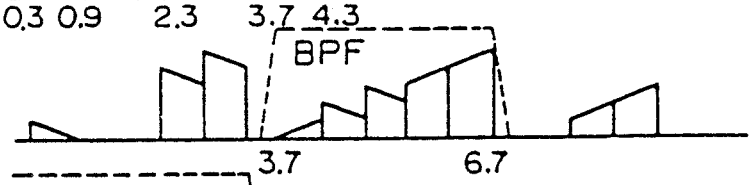
Figure 11G:
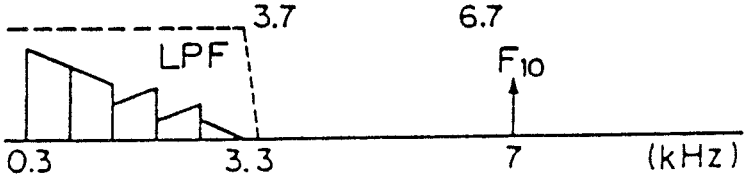

FIG. 10 is a block diagram showing an essential constitution of a second embodiment of the present invention.

A constitution for splitting the band of an input speech signal is the same as that for the first embodiment of the present invention, and thus is omitted from the figure.

In the figure, carriers $F_{11}$ to $F_{15}$ having different frequencies respectively are input to multipliers 331 to 335 corresponding to respective channels, respective outputs of the multipliers 331 to 335 are input to an adder 341, an output of the adder 341 is input to a multiplier 361 through a bandpass filter (BPF) 351, and an output multiplied by the carrier $F_{10}$ of the multiplier 361 is sent to an output terminal 373 through a low-pass filter (LPF) 371.

Here, the modulating means 15 shown in the block diagram (FIG. 1) of the principle of the embodiment of the present invention corresponds to the multipliers 331 to 335 of this embodiment (FIG. 10). Similarly, the adding means 17 corresponds to the adder 341, bandpass filter 351, multiplier 361, and low-pass filter 371.

A feature of this embodiment is that the bands of noninverting and inverting carriers are set such that, for example, the band of an upper sideband of a signal modulated with the noninverting carrier coincides with the band of a lower sideband of a signal modulated with the inverting carrier.

Table 5 shows examples of combinations of carrier frequencies which have been set in the above-mentioned relationship.

TABLE 5

| | Normal kHz | Inverting kHz |
|---|---|---|
| a | 4.7 | 8.1 |
| b | 4.1 | 7.5 |
| c | 3.5 | 6.9 |
| d | 2.9 | 6.3 |
| e | 2.3 | 5.7 |

TABLE 6

| Carriers for channels | | (kHz) |
|---|---|---|
| $F_{11}$ | a | (4.7) |
| $F_{12}$ | b | (4.1) |
| $F_{13}$ | c | (6.9) |
| $F_{14}$ | d | (6.3) |

TABLE 6-continued

| Carriers for channels | (kHz) | |
|---|---|---|
| $F_{15}$ | e | (2.3) |

Table 6 shows, as indicated with respect to the first embodiment, examples of frequencies of the carriers $F_{11}$ to $F_{15}$ corresponding to the channels, particularly without band relocation.

FIG. 11 is a view corresponding to Table 6 and explaining signal spectra after the multipliers 331 to 335. FIGS. 11A to 11E show respective outputs of the multipliers 331 to 335, FIG. 11F an output of the adder 341, and FIG. 11G an output of the multiplier 361 (an upper sideband (10.7 kHz to 13.7 kHz) is omitted).

As shown in FIG. 11, if the noninverting and inverting carriers have the above-mentioned relationship, it is not necessary to separate a noninverting route and an inverting route corresponding to channels by a switching circuit. By setting a passband of the bandpass filter 351 from 3.7 kHz to 6.7 kHz, and by setting the carrier $F_{10}$ of the multiplier 361 to 7 kHz, a scrambled voice signal modulated to a base band (0.3 kHz to 3.3 kHz) is obtained.

As described above, it is necessary only to finally modulate the signal to the base band with the carrier $F_{10}$ of the multiplier 361, and the frequency band (2.3 kHz to 4.7 kHz) of the normal carrier shown here is not definitive.

For example, a passband of the bandpass filter ($BPF_2$) is generally assumed to be from m to n (kHz) (where$_{13}$ $=m+n$), and a frequency band of the noninverting carrier is assumed to be from p to $p+\alpha$ (kHz). Then a frequency band of the inverting carrier will be form $p\pm_{13}$ to $p+\alpha\pm$_(kHz), and thus will be realized by properly setting the carrier $F_{10}$ of the multiplier 361.

As described with reference to the first and second embodiments, the present invention reduces the amount of hardware (for example, multipliers) for the band relocation and spectrum inversion processes by adjusting carrier frequencies. For example, in the conventional system shown in FIG. 13, 15 multipliers and 12 bandpass filters must be provided, whereas, in the embodiment of the present invention shown in FIG. 2, only 11 multipliers and 8 bandpass filters are necessary.

Although the above embodiments have dealt with five channels, the present invention is applicable even if the number of channels (the number of divided bands) is increased. In this case, the reduction of the hardware required is remarkable.

As described above, according to the present invention, by properly selecting carriers for band relocation and by collectively performing a spectrum inverting process and a band relocating process, the number of multipliers may be reduced, for example, from fifteen to eleven in the case of five channels, thereby reducing the number of poles of bandpass filters shown in the embodiments, to simplify the hardware. If the number of band-divided-channels is increased, a further reduction of the hardware is realized to remarkably improve the practicability of the apparatus.

We claim:

1. A voice band splitting scrambler, comprising:

band splitting means for splitting an input voice signal into a plurality of band channels producing a split bandwidth, said bandsplitting means comprising:

frequency modulating means for modulating the input voice signal by an integer multiple of the split bandwidth and producing an output; and bandpass filters each for passing a predetermined band signal form each output of said frequency modulating means; and scrambled voice signal generating means for carrying out spectrum-inverting and band-relocating operations on the respective channels to generate a scrambled voice signal, said scrambled voice signal generating means comprising:

modulating means for band relocating respective channels by noninverting carriers and inverting carriers set in different bands respectively, said relocating creating inverted and noninverting channels; and adding means for adding signals of the noninverted channels and signals of the inverted channels to each other.

2. A voice band splitting scrambler as claimed in claim 1, wherein said frequency modulating means utilize carrier frequencies for modulating respective frequency bands, said frequency bands caused by splitting the frequency band of the input voice signal to lower a frequency.

3. A voice band splitting scrambler as claimed in claim 2, wherein said carrier frequencies are selected so that, when an upper frequency band is relocated to a lower frequency band, the input voice signal is not superposed on a reflected signal of the lower frequency band.

4. A voice band splitting scrambler as claimed in claim 1, wherein said bandpass filters pass a same frequency band.

5. A voice band splitting scrambler as claimed in clam 1, wherein said non-inverting carriers and said inverting carriers comprise first and second sets of carrier signals respectively and wherein said bandpass filters have frequency characteristics allowing passage of lower side bands with respect to said second set of carrier signals, placing signals of said split bandwidth passing through said bandpass filters in said lower side bands with respect to said second set of carrier signals.

6. A voice band splitting scrambler as claimed in claim 5, wherein a part of said first set of carrier signals are noninverting carrier signals, and a remaining part of said first set of carrier signals are inverting carrier signals, said noninverting carrier signals and said inverting carrier signals producing an upper sideband of a signal modulated by said noninverting carriers coinciding with a lower sideband of a signal modulated by said by inverting carriers.

7. A voice band splitting scrambler, comprising:

band splitting means for splitting an input voice signal into a plurality of band channels; and scrambled voice signal generating means for carrying out spectrum-inverting and band-relocating operations on the respective channels to generate a scrambled voice signal, said scrambled voice signal generating means comprising:

modulating means for band relocating respective channels by noninverting carriers and inverting carriers set in different bands respectively, said relocating creating inverted and noninverted channels; and adding means for adding signals of the noninverted channels and signals of the inverted channels to each other, said adding means comprising:

first adding means for adding the signals of the inverted channels and producing an output;

second adding means for adding the signals of the inverted channels and producing an output;

means for modulating at least one of the added signals; and means for adding the output of one of said first and second adding means to the output of said modulating means to form a continuous spectrum.

8. A voice band splitting scrambler, comprising:

band splitting means for splitting an input voice signal into a plurality of band channels; and scrambled voice signal generating means for carrying out spectrum-inverting and band-relocating operations on the respective channels to generate a scrambled voice signal, said scrambled voice signal generating means comprising:

modulating means for band relocating respective channels by noninverting carriers and inverting carriers set in different bands respectively, said relocating creating inverted and noninverted channels; and adding means for adding signals of the noninverted channels and signals of the inverted channels to each other, said noninverting carriers and said inverting carriers producing an upper sideband of a signal modulated by said noninverting carriers coinciding with a lower sideband of a signal modulated by said inverting carriers.

9. A voice band splitting scrambler, comprising:

first n-frequency modulating means for modulating an input analog voice signal into respective different frequencies and producing outputs;

bandpass filters for passing predetermined band signals from the respective outputs of said first n-frequency modulating means and producing outputs;

second n-frequency modulating means for modulating the respective output signals of said bandpass filters and producing output signals;

switching means for separately producing noninverted signals and inverted signals from the output signals of said second n-frequency modulating means;

first adding means for adding the noninverted signals output from said switching means;

second adding means for adding the inverted signals output from said switching means;

third modulating means for frequency modulating a predetermined band signal output from said second adding means and outputting signals; and third adding means for adding the noninverted signals and the signals output from said third frequency modulating means to output added signals.

10. A voice band splitting scrambler as claimed in claim 9, wherein said first frequency modulating means utilizes modulating frequencies for relocating the input analog voice signal to a lower frequency.

11. A voice band splitting scrambler as claimed in claim 10, wherein amounts of shift by said modulating frequencies are determined to be integer multiples of 1/n an input voice bandwidth.

12. A voice band splitting scrambler as claimed in claim 11, wherein the amounts of shift are selected such that, when an upper band of 1/n split of said input voice bandwidth is relocated to a lower band, a reflected signal is not superposed on the voice signal.

13. A voice band splitting scrambler as claimed in claim 9, wherein said bandpass filters have frequency band characteristics that are the same.

14. A voice band splitting scrambler as claimed in claim 9, wherein an amount of shift due to relocation of the frequency band in said second n-frequency modulating means is controlled by predetermined data.

15. A voice band splitting scrambler as claimed in claim 14, wherein the switching means is controlled so that output signals of the inverted signals modulated by said second n-frequency modulating means are collected.

16. A voice band splitting scrambler as claimed in claim 9, further including first and second sets of carrier signals and wherein said bandpass filters have frequency characteristics allowing passage of lower side bands with respect to said second set of carrier signals, placing signals of a split bandwidth passing through said bandpass filters in said lower side bands with respect to said second set of carrier signals.

17. A voice band splitting scrambler as claimed in claim 16, wherein a part of said first set of carrier signals are noninverting carrier signals, and a remaining part of said first set of carrier signals are inverting carrier signals, said noninverting carrier signals producing an upper sideband of a signal modulated by said noninverting carrier signals coinciding with a lower sideband of a signal modulated by said inverting carrier signals.

18. A voice band splitting scrambler, comprising:

first n-frequency modulating means for modulating input analog voice signals into respective different frequencies;

bandpass filters for passing predetermined band signals from respective outputs of said first n-frequency modulating means;

second n-frequency modulating means for modulating the respective output signals of said bandpass filters;

adding means for adding outputs of said second n-frequency modulating means;

third modulating means for frequency modulating a predetermined band signal taken out from an output of said adding means; and a low-pass filter for passing a predetermined relocated signal within an input voice bandwidth from an output signal of said third frequency modulating means.

19. A voice band splitting scrambler as claimed in claim 18, wherein said first n-frequency modulating means utilizes modulating frequencies for relocating an input analog speech signal to a lower frequency.

20. A voice band splitting scrambler as claimed in claim 19, wherein amounts of shift due to the relocating by said modulating are determined to be integer multiples of 1/n of the input voice bandwidth.

21. A voice band splitting scrambler as claimed in claim 20, wherein amounts of shift due to the relocating are so selected that, when an upper band of 1/n split of said input voice bandwidth is relocated to a lower band, a reflected signal is not superposed on the voice signal.

22. A voice band splitting scrambler as claimed in claim 18, wherein said bandpass filters have frequency band characteristics which are the same.

23. A voice band splitting scrambler as claimed in claim 18, wherein an amount of shift of the relocated signal is controlled by predetermined data.

24. A voice band splitting scrambler as claimed in claim 18, further including first and second sets of carrier signals and wherein said bandpass filters have frequency characteristics allowing passage of lower side bands with respect to said second set of carrier signals, placing signals of a split bandwidth passing through said bandpass filters in said lower side bands with respect to said second set of carrier signals.

25. A voice band splitting scrambler as claimed in claim 24, wherein said second set of carrier signals includes carrier frequencies and said carrier frequencies of said second set of carrier signals are selected to be as low as possible without distorting outputs of said bandpass filters due to signal components of said lower side bands reflected by a direct current component.

26. A voice band splitting scrambler, comprising:

band splitting means for splitting an input voiceband into a plurality of different subbands each subband having a bandwidth the same width, said different subbands, when combined, forming a sideband of said input voiceband; and scrambled voice signal generating means, operatively connected to said band splitting means, for obtaining, from said different subbands, a scrambled voiceband in which each of said different subbands is relocated and at least a part of said different subbands is inverted in frequency, said scrambled voice signal generating means comprising:

first modulating means, operatively connected to said band splitting means, for effecting frequency modulation on said different subbands by the use of a first set of carrier signals producing upper sidebands and lower sidebands with respect to said first set of carrier signals; and adding means, operatively connected to said modulating means, for adding a part of said lower sidebands and a part of said upper sidebands producing an added result, frequencies of said first set of carrier signals producing the added result including a scrambled voiceband having said different subbands relocated to form a continuous spectrum and at least a part of said different subbands is inverted in frequency.

* * * * *